United States Patent [19]

Suh

[11] Patent Number: 4,703,600

[45] Date of Patent: Nov. 3, 1987

[54] VERTICALLY ASSEMBLING BOX TYPE BLOCKS

[76] Inventor: Kun H. Suh, 1302, B-dong, Changmi Apt., 40 Yoeuido-dong, Yongdeungpo-Ku, Seoul 150, Rep. of Korea

[21] Appl. No.: 826,492

[22] PCT Filed: Apr. 30, 1985

[86] PCT No.: PCT/KR85/00010

§ 371 Date: Dec. 30, 1985

§ 102(e) Date: Dec. 30, 1985

[87] PCT Pub. No.: WO85/05140

PCT Pub. Date: Nov. 21, 1985

[30] Foreign Application Priority Data

Apr. 30, 1984 [KR] Rep. of Korea ..... 1984/4046[U]
May 10, 1984 [KR] Rep. of Korea ..... 1984/4320[U]

[51] Int. Cl.[4] ..... E04C 1/08; E04H 17/04; E06B 11/02

[52] U.S. Cl. ..... 52/437; 52/585; 52/608

[58] Field of Search ..... 52/726, 586, 585, 437, 52/609, 436, 429, 430, 608, 301

[56] References Cited

U.S. PATENT DOCUMENTS

| | | | |
|---|---|---|---|
| 293,800 | 2/1884 | Simonds | 52/437 |
| 869,518 | 10/1907 | Rector | 52/437 |
| 938,140 | 10/1909 | Goucher | 52/585 |
| 1,350,399 | 8/1920 | Wilson | 52/609 |
| 1,435,865 | 11/1922 | McDaniel | 52/437 |
| 1,444,554 | 2/1923 | Quillet | 52/585 |
| 2,861,388 | 11/1958 | Favaretto | 52/606 |
| 3,318,059 | 5/1967 | Wright | 52/437 |
| 3,795,079 | 3/1974 | Klem | 52/437 |
| 4,110,949 | 9/1978 | Cambiuzzi | 52/606 |

FOREIGN PATENT DOCUMENTS

| | | | |
|---|---|---|---|
| 874369 | 3/1953 | Fed. Rep. of Germany | 52/437 |
| 248410 | 5/1947 | Switzerland | 52/271 |

*Primary Examiner*—John E. Murtagh
*Attorney, Agent, or Firm*—Cushman, Darby & Cushman

[57] ABSTRACT

A box-type masonry block comprising a quadrangular or H-type concrete block body provided at the interior thereof with a space. The block also includes an engaging step formed at inner upper surface of said block body, an engaging protrusion formed at lower surface of said block body, and a fixing rod-receiving hole formed at each corner of said block body.

5 Claims, 11 Drawing Figures

Fig. 3
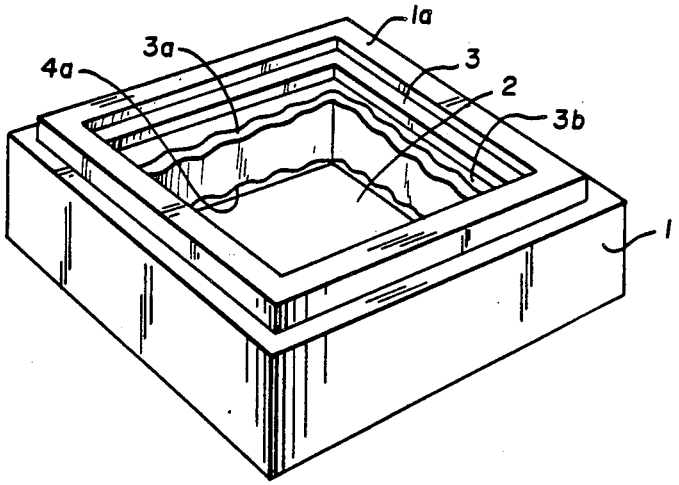
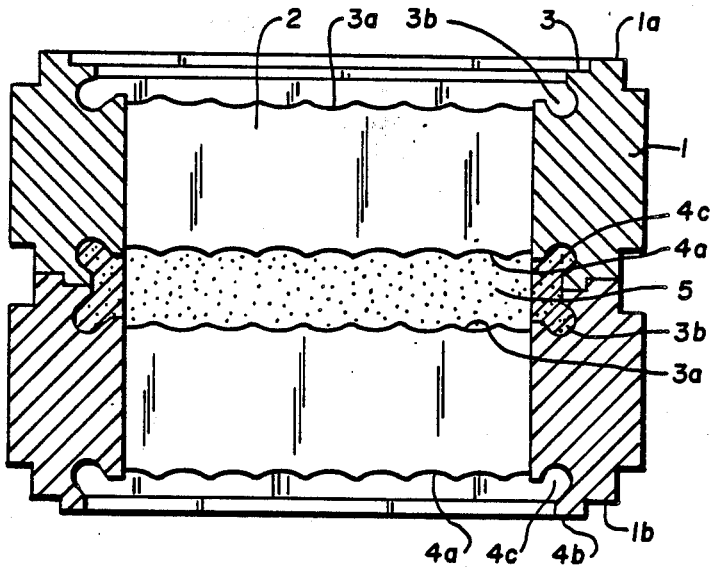
Fig. 4

Fig. 5
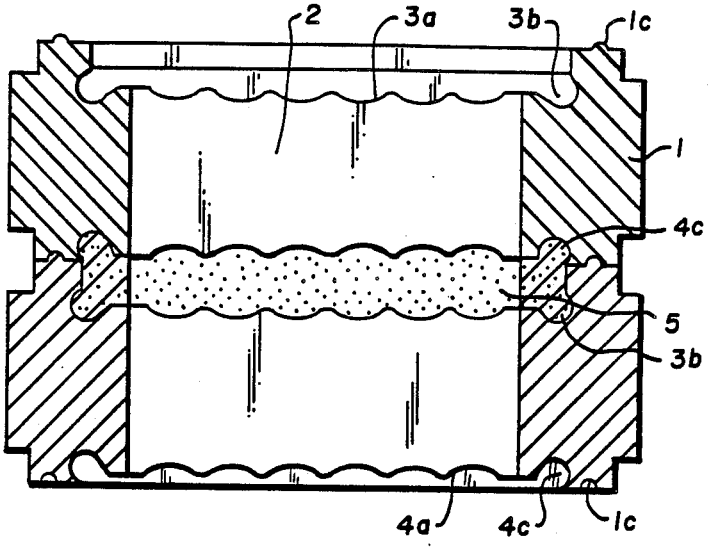
Fig. 6a
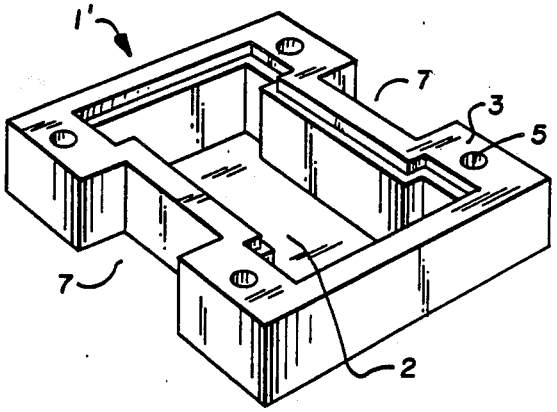
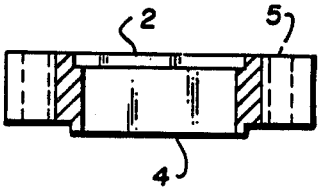
Fig. 6b

Fig. 7
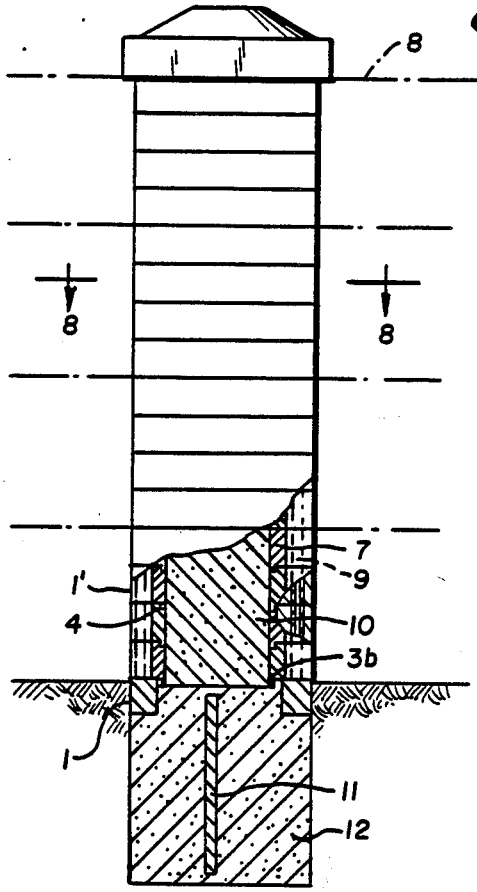
Fig. 8
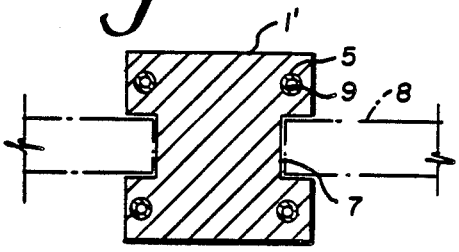
Fig. 9a
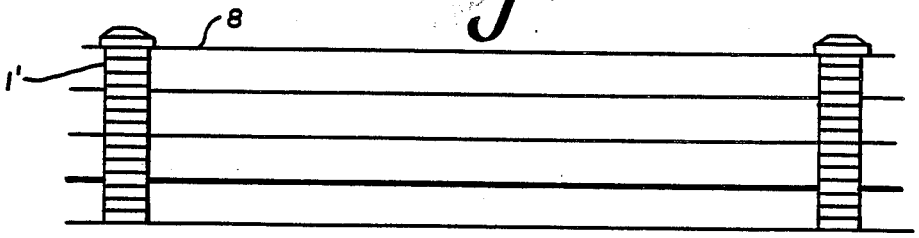
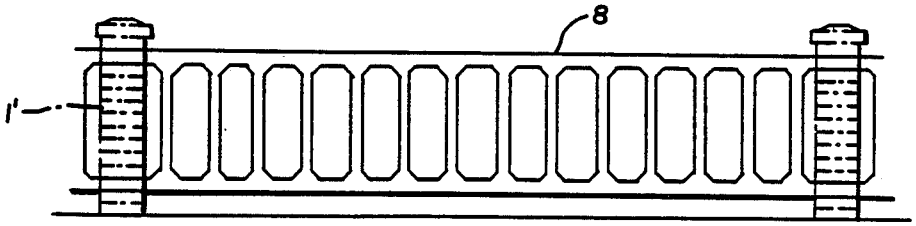
Fig. 9b

VERTICALLY ASSEMBLING BOX TYPE BLOCKS

BACKGROUND OF THE INVENTION

The present invention relates to a quadrangular or H-box-type masonry block for constructing a pillar of fence or a flower pot for landscape, or utilizing for a landscape.

Hereinbefore, various concrete pillars have been proposed and utilized for constructing a fabricated fence. In most conventional constructions, however, straight grooves having certain width and depth are vertically formed at both side surfaces of the pillar. When using such construction of pillar, pillars are fixedly buried at respective lower ends thereof into the ground. Adjacent pillars are vertically disposed, and spaced from each other at a distance corresponding to a longitudinal width of a plate-type concrete wall member used as a fence. Then, a fence can be constructed by lifting up each wall member above the height of pillar, engaging both ends of said wall member into corresponding grooves of pillar, and then pushing down said wall member. In such process, however, much labor and equipment are needed because of the lifting up of heavy concrete wall members and engaging of wall members into grooves of the pillars every time. When the wall member is engaged between adjacent pillars, one pillar may incline outwardly, thereby causing an accuracy of constructing work to be reduced. In addition, there is a problem that a long time is needed for sufficiently curing a cement mortar supplied when a pillar is fixed on the ground.

SUMMARY OF THE INVENTION

Accordingly, an object of the present invention is to eliminate the above-mentioned disadvantages encountered in the prior arts and to provide a box-type masonry block enabling a pillar to be stepwisely constructed to a desired height under conditions that wall member or fence is held at a certain position.

Another object of the present invention is to provide a box-type masonry block enabling construction of a flower box at roadsides or a flower garden.

According to the present invention, these and other objects are accomplished by providing a box-type masonry block comprising a square or rectangular block body provided at the interior thereof with a square or rectangular space, said body having a uniform thickness, an engaging groove formed at upper edge of said block body, an engaging protrusion formed at lower edge of said block body and adapted to engage with corresponding groove of adjacent block, and fixing rod-receiving holes formed at corners of said block body or desired positions on said block body, respectively.

According to the present invention, the block may be provided at the upper surface thereof a fixing protrusion and at the lower surface with a fixing groove.

The word "box-type" referred herein means all possible shapes such as quadrangular, H-type, or circular shapes. To clarify the description of present invention, however only square or rectangular block will be described.

Thus, a masonry block of the present invention can be advantageously and easily applied to a construction of pillar of fabricated fence or like, as well as an onsite construction of simple flower box, in virtue of enabling a mass production of blocks.

Other objects and advantage of the present invention will be apparent from the following descriptions taken in conjunction with the accompanying drawings.

BRIEF DESCRIPTION OF THE DRAWINGS

FIG. 3 is a perspective view of a box-type masonry block according to another embodiment of the present invention;

FIG. 4 is a sectional view showing a condition when two blocks of FIG. 3 are assembled with each other;

FIG. 5 is a sectional view similar to FIG. 4 showing a block provided with an engaging groove and an engaging protrusion;

FIG. 6(*a*) and 6(*b*) are perspective and sectional views, respectively, of a box-type masonry block according to another embodiment of the present invention;

FIG. 7 is a partially broken out-sectional view of a pillar constructed by laying blocks of FIG. 6;

FIG. 8 is a cross-sectional view taken along a line A—A in FIG. 7;

FIG. 9(*a*) and (*b*) are schematic views showing applications of the masonry blocks of present invention to a fence, respectively; and FIG. 10 is a schematic view of a flower box constructed by masonry blocks of the present invention.

DETAILED DESCRIPTION OF THE PREFERRED EMBODIMENT

Figure 1:
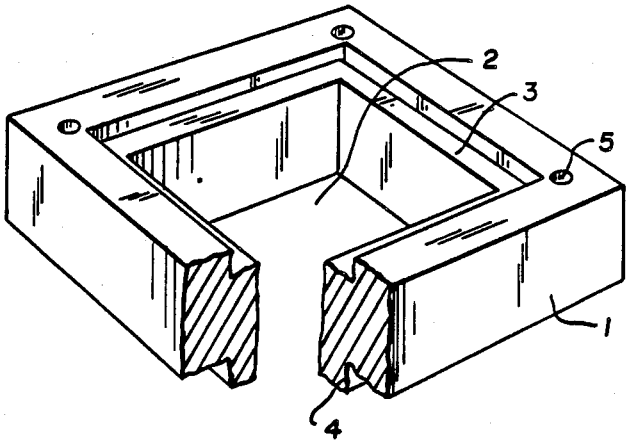
FIG. 1 is a partially broken out-perspective view of a box-type masonry block according to an embodiment of the present invention.

Referring to FIG. 1, a box-type masonry block 1 of the present invention is shaped into a lattice form having a space at the interior thereof. The block 1 is provided at the upper surface thereof with a surface having a lower level than that of said upper surface to define an engaging step 3. The block 1 also has at the lower surface thereof an engaging protrusion 4 adapted to seat on the step 3 of other block. Adjacent to each corner of block 1, a hole 5 for receiving a fixing rod is formed.

Figure 2:
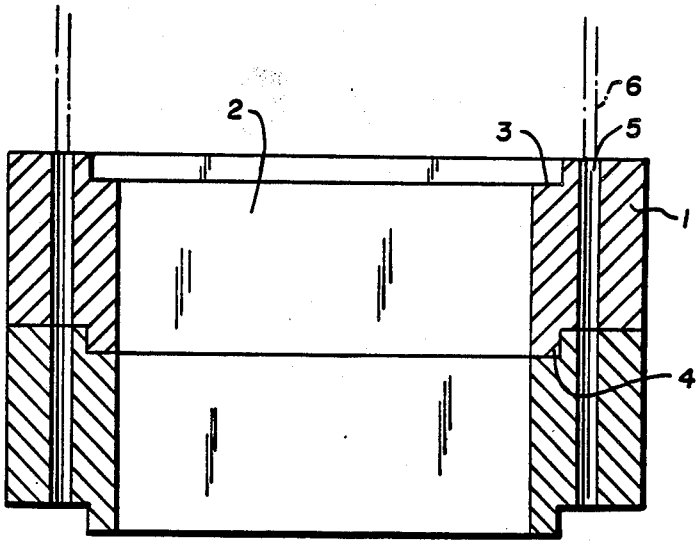
FIG. 2 is a sectional view showing a condition when two blocks of FIG. 1 are assembled with each other.

As shown in FIG. 2, a pillar having a desired height can be constructed by using masonry blocks of the present invention in a manner that one block 1 is successively laid down on the other block 1 one by one to seat a protrusion 4 of said one block on a step 3 of said other block. In constructing such pillar, each hole 5 is inserted into the corresponding rod 6 made of reinforcing bar every time of laying down one block on the other block. Accordingly, a safety of result product can be more insured. The space 2 is remained to be empty. Of course, the space 2 may be filled with a cement mortar, as the case may be. In the case that the space 2 is remained to be empty, adjacent modular blocks can be jointed at joint surfaces thereof by a cement mortar.

FIG. 3 shows a modification of the block of FIG. 1, in which a wave surface is formed at a position below upper engaging step 3 to define a second upper engaging step 3*a*. An annular groove 3*b* is formed between the upper engaging step 3 and the second engaging step 3*a*. At upper and lower surfaces, the block 1 has upper protruding edge 1*a* and lower protruding edge 16, respectively. When one block 1 is laid down on the other block 1, said upper and lower protruding edges 1*a* and 1*b* define an interacting engagement area. Above the lower protruding edge 1*b*, a lower engaging step 4 is disposed. A lower annular groove 4*c* is formed between the lower protruding edge 1*b* and the lower engaging step 4*a*.

FIG. 4 shows a condition of laying two masonry blocks 1 of FIG. 3. One block 1 is laid down on the other block 1 such that the lower protruding edge 1*b* of upper block seats on the upper protruding edge 1*a* of lower block. Then a cement mortar 5 is poured into a space defined between annular grooves 4*c* and 3*a*, that is, between the lower engaging step 4*a* of upper block and the upper engaging step 3*a* of lower block, through the space 2 of block. After curing the cement mortar 5, laying a plurality of masonry blocks is completed.

FIG. 5 is a sectional view similar to FIG. 4. The block construction of FIG. 5 is similar to that of FIG. 3, except that the upper engaging step 3 is omitted. The block is provided at the center of upper protruding edge 1*a* with a fixing protrusion 1*c* and at the center of lower protruding edge 1*b* with a fixing groove 1*e*. The block 1 is shaped into a H form having a recess 7 of a certain size at each side surface thereof. The block 1 has a space 2 at the center thereof and fixing holes 5 of four corners or other desired positions. As shown in FIG. 7, the size of recess 7 may be variously determined depending on the thickness of concrete wall member 8 adapted to be fixedly inserted into said recess 7. In the drawing, a reference numeral 9 designates a metal core for reinforcement, and 10 mortar.

Hereinafter, an operation of using masonry blocks of the present invention will be described with reference to FIGS. 7 to 9.

At an area to place blocks of the present invention, a ground is dug to provide a cavity of desired depth. Then, a reinforcing bar 11 is disposed in the cavity and a cement concrete 12 is poured into the cavity. Thereafter, a box-type masonry block 1 of FIG. 1 is laid on and partially buried into the cement concrete layer. Thus, the foundation work is completed. Thereafter, a H-type block 1 is laid down on the block seated on the cement concrete layer, such that an engaging protrusion 4 formed at the lower surface of said H-type block 1 is engaged with the upper surface of said lower block. Then, another H-type block 1' is laid down on said H-type block 1, such that an engaging protrusion 4 of upper block 1' is engaged with an engaging groove 3*b* of lower block 1. At the same time, each fabricated concrete wall member 8 is inserted at the both end thereof into recesses 7 of blocks. Thus, a fence can be constructed as shown in FIG. 9(*a*). After laying blocks and assembling wall members with the blocks, a reinforcing bar 9 is inserted into each hole 5 of blocks and the space 2 of blocks is filled with a cement mortar 10. Thus, blocks are formed into an integral member.

Also, it is possible to assemble or construct a wall as shown in FIG. 9(*b*) or a base block for a fence by disposing H-type blocks at desired positions in laying blocks shown in FIGS. 1 to 3.

Masonry blocks of the present invention can be applied to a construction of flower box, when laying at least two blocks, as shown in FIG. 10.

As apparant from the above description, masonry blocks of the present invention can be easily applied to a construction of pillar of fabricated fence or like, as well as a on-site construction of simple flower box, in virtue of enabling a mass production of blocks.

What is claimed is

1. A box-type of masonry block comprising:

a substantially rectangular concrete block body having side walls which define a hollow interior portion and define upper and lower peripheral surfaces of said block body;

an upper flange element formed along said upper peripheral surface of said block body;

a lower flange element formed along said lower peripheral surface of said block body for engaging a corresponding upper flange element of a downwardly-adjacent block body;

upper engaging means formed along at least a portion of said upper flange element;

lower engaging means formed along at least a portion of said lower flange element for engaging a corresponding first upper engaging means of a downwardly-adjacent block;

upper rib means formed peripherally about an uppermost portion of the walls of said hollow interior portion, said upper rib means being wave-shaped such that the uppermost surface thereof undulates along at least a portion of the length thereof, about the periphery of said hollow interior portion;

lower rib means formed peripherally about a lowermost portion of the walls of said hollow interior portion, said lower rib means being wave-shaped such that the lowermost surface thereof undulates along at least a portion of the length thereof, about the periphery of said hollow interior portion; and upper and lower annular grooves surrounding and disposed outwardly relative to said upper and lower rib means, respectively.

2. A box-type masonry block as claimed in claim 1, wherein said upper engaging means comprises a cut-out step portion and said lower engaging means comprises a protruding step portion for interlocking with a corresponding cut-out step portion of a downwardly-adjacent block body.

3. A box-type masonry block as claimed in claim 1, wherein said upper engaging means comprises at least two fixing protrusion elements and said lower engaging means comprises at least two fixing groove elements for interlocking with corresponding fixing protrusion elements of a downwardly-adjacent block.

4. A box-type masonry block comprising:

a substantially H-shaped concrete block body having side walls which define a hollow interior portion and define upper and lower peripheral surfaces of said block body;

an upper flange element formed along said upper peripheral surface of said block body;

a lower flange element formed along said lower peripheral surface of said block body for engaging a corresponsding upper flange element of a downwardly-adjacent block body;

upper engaging means formed along at least a portion of said upper flange element;

lower engaging means formed along at least a portion of said lower flange element for engaging a corresponding first upper engaging means of a downwardly-adjacent block;

upper rib means formed peripherally about an uppermost portion of the walls of said hollow interior portion, said upper rib means being wave-shaped such that the uppermost surface thereof undulates along at least a portion of the length thereof, about the periphery of said hollow interior portion;

lower rib means formed peripherally about a lowermost portion of the walls of said hollow interior portion, said lower rib means being wave-shaped such that the lowermost surface thereof undulates along at least a portion of the length thereof, about the periphery of said hollow interior portion; and upper and lower annular grooves surrounding and disposed outwardly relative to said upper and lower rib means, respectively.

5. A box-type masonry block as claimed in claim 4, wherein said upper engaging means comprises at least two fixing protrusion elements and said lower engaging means comprises at least two fixing groove elements for interlocking with corresponding fixing protrusion elements of a downwardly-adjacent block.

* * * * *